US010181681B1

(12) United States Patent
Klein

(10) Patent No.: US 10,181,681 B1
(45) Date of Patent: Jan. 15, 2019

(54) EQUIPOTENTIAL GROUNDING GRATE

(71) Applicant: EDK Innovations, LLC, Canton, OH (US)

(72) Inventor: Erik D. Klein, Uniontown, OH (US)

(73) Assignee: EDK Innovations, LLC, Canton, OH (US)

( * ) Notice: Subject to any disclaimer, the term of this patent is extended or adjusted under 35 U.S.C. 154(b) by 0 days.

(21) Appl. No.: 16/015,603

(22) Filed: Jun. 22, 2018

Related U.S. Application Data

(60) Provisional application No. 62/523,671, filed on Jun. 22, 2017, provisional application No. 62/524,366, filed on Jun. 23, 2017, provisional application No. 62/566,972, filed on Oct. 2, 2017.

(51) Int. Cl.
*E01C 5/16* (2006.01)
*H01R 13/648* (2006.01)
*E01C 9/08* (2006.01)

(52) U.S. Cl.
CPC ..... *H01R 13/648* (2013.01); *E01C 9/08* (2013.01)

(58) Field of Classification Search
CPC ... E01C 9/083; E01C 5/00; E01C 9/08; E01C 5/22; E01C 15/14
USPC ..... 404/35, 34, 36, 44, 47
See application file for complete search history.

(56) References Cited

U.S. PATENT DOCUMENTS 4,967,057 A 10/1990 Bayless et al.
5,577,687 A 11/1996 Downing
5,653,551 A 8/1997 Seaux
6,007,271 A 12/1999 Cole et al.
6,278,085 B1 8/2001 Abukasm
6,477,027 B1 11/2002 McKelvy
6,511,257 B1 1/2003 Seaux et al.
6,888,081 B2 5/2005 Friedrich et al.
7,370,452 B2 5/2008 Rogers
7,404,690 B2 7/2008 Lukasik et al.
7,413,374 B2 8/2008 Rogers et al.
7,427,172 B2 9/2008 Lukasik
7,604,431 B2 10/2009 Fournier
7,645,962 B2 1/2010 Krossa et al.
8,061,929 B2 11/2011 Dagesse
(Continued)

FOREIGN PATENT DOCUMENTS

CH 688966 A5 6/1998
CN 87212162 U 7/1988
(Continued)

OTHER PUBLICATIONS

Sep. 4, 2015 Sterling Press Release.
(Continued)

*Primary Examiner* — Phuong Chi T Nguyen
(74) *Attorney, Agent, or Firm* — Zollinger & Burleson Ltd.

(57) ABSTRACT

Self-supporting equipotential grounding grates are used to create an equipotential zone for workers and equipment. The grates have a plurality of supports that cooperate to position the upper surface of a conductive grid above the surface on which the grates are used. The inner supports include upper and lower structural grids that allow debris to be readily removed from the grate after use. The grate supports workers and equipment. A plurality of the grates are electrically connected with cables to define a platform with the entire structure grounded with one or more grounding pins.

20 Claims, 12 Drawing Sheets

(56) References Cited

U.S. PATENT DOCUMENTS

| | | | | |
|---|---|---|---|---|
| 8,382,393 | B1 | 2/2013 | Phillips | |
| 8,414,217 | B2 | 4/2013 | Rosan | |
| 8,511,257 | B2 | 8/2013 | Thibault | |
| 8,545,127 | B2 | 10/2013 | Bleile et al. | |
| 8,616,804 | B2 | 12/2013 | Corser | |
| 8,902,559 | B2 | 12/2014 | Xu | |
| 8,936,073 | B1 | 1/2015 | Phillips | |
| 8,951,055 | B2 | 2/2015 | Eusterholz | |
| 9,068,584 | B2 | 6/2015 | McDowell et al. | |
| 9,212,746 | B2 | 12/2015 | McDowell | |
| 9,337,586 | B2 | 5/2016 | McDowell et al. | |
| 9,368,918 | B2 | 6/2016 | McDowell et al. | |
| 9,450,126 | B1 | 9/2016 | Streett et al. | |
| 9,458,578 | B2 | 10/2016 | Klein | |
| 9,735,510 | B2 | 8/2017 | McDowell et al. | |
| 9,909,708 | B1 * | 3/2018 | Penland, Jr. | E02D 17/10 |
| 9,915,036 | B2 * | 3/2018 | Penland, Jr. | B32B 21/12 |
| 9,972,942 | B1 * | 5/2018 | Bordelon | E04H 3/126 |
| 9,985,390 | B2 * | 5/2018 | McDowell | H02B 13/025 |
| 2002/0178661 | A1 | 12/2002 | Burke et al. | |
| 2004/0154908 | A1 | 8/2004 | Friedrich et al. | |
| 2004/0253861 | A1 | 12/2004 | Schubert et al. | |
| 2005/0239320 | A1 | 10/2005 | Folkema | |
| 2005/0270175 | A1 | 12/2005 | Peddie et al. | |
| 2007/0237581 | A1 | 10/2007 | Lukasik et al. | |
| 2007/0258767 | A1 | 11/2007 | Tapp | |
| 2008/0075533 | A1 | 3/2008 | Fournier | |
| 2013/0051911 | A1 | 2/2013 | Corser | |
| 2013/0264773 | A1 | 10/2013 | McDowell | |
| 2013/0309008 | A1 | 11/2013 | Fournier | |
| 2014/0189985 | A1 | 7/2014 | McDowell et al. | |
| 2014/0193196 | A1 | 7/2014 | Fournier | |
| 2014/0255108 | A1 | 9/2014 | McDowell | |
| 2015/0029040 | A1 | 1/2015 | McDowell et al. | |
| 2015/0099377 | A1 | 4/2015 | McDowell et al. | |
| 2015/0101831 | A1 | 4/2015 | Dugas et al. | |
| 2015/0266669 | A1 | 9/2015 | McDowell | |
| 2016/0017547 | A1 | 1/2016 | Bordelon et al. | |
| 2016/0017910 | A1 | 1/2016 | McDowell et al. | |
| 2016/0032537 | A1 | 2/2016 | Edwards et al. | |
| 2016/0076204 | A1 | 3/2016 | McDowell | |
| 2016/0090806 | A1 | 3/2016 | Dugas et al. | |
| 2016/0118747 | A1 | 4/2016 | McDowell et al. | |
| 2016/0301161 | A1 | 10/2016 | McDowell et al. | |
| 2016/0312490 | A1 | 10/2016 | McDowell et al. | |
| 2016/0355995 | A1 | 12/2016 | Edwards et al. | |
| 2016/0355996 | A1 | 12/2016 | Edwards et al. | |
| 2017/0073904 | A1 | 3/2017 | McDowell et al. | |

FOREIGN PATENT DOCUMENTS

| | | |
|---|---|---|
| EP | 1128713 | 8/2001 |
| WO | 2002072974 A1 | 9/2002 |

OTHER PUBLICATIONS

Sterling EquiPotential Matting; publication date unknown, access from http://www.sterlingcranemats.com/ Sep. 18, 2015.

Aug. 2013, Temporary Grounding for Lineworker Protection, How to Safely Install and Remove Personal Protective Grounds, Fifth Edition, Second printing Aug. 2013, Alexander Publications, see Appendix B, pp. 91-96.

Jan. 2010, Grounding for Lineworker Protection, Second Edition, First printing Jan. 2010, Alexander Publications, see Appendix B, pp. 85-89.

Sep. 2007, Live Line Work Practices, Second Edition, First printing: Sep. 2007, Alexander publications 2002, Chapters 10 and 11, see pp. 403-406, 436.

May 9, 2014, Document 5.3.2 Environmental Statement Project Description Appendices, Hinkley Point C Connection Project, Appendix 3G: Risk Assessments and Method Statements.

Copyright 2010, Kri-Tech Products Ltd, Portable Protective Bond Mat.

May 2017, photos 1 and 2 of EPZ zone from PAR Electric, used in USA prior to May 2017, dates of use unknown.

Jul. 23, 2012, photos 1 and 2 of grounding mats used by MJ Electric in USA.

Aug. 10, 2012, photos 1-4 of grounding mats used by MJ Electric in USA.

Dec. 2012, photos 1-9 of welded 4×8 steel conductive mats used by MJ Electric in Iowa, USA.

Jan. 17, 2012, Terrafirma, Electricity Alliance Sums up Dura-Base Mats . . . Security, Savings, and Service.

Aug. 2012, photos of conductive grid on Dura-Base Mats from Balfour Beatty Utility Services.

Summer 2015, Transmission Line, An M.J. Electric Publication, p. 4, Equipotential Zone (EPZ) Advancements.

Hastings grounding and Jumper Equipment, Grounding Mat, Jan. 2011, 1 pp.

The World's Latest Trackway, Copyright Liontrackhire 2015, http://www.liontrackhire.com/trackway/, 8 pp.

Standard (Orange) Equi-Mat Personal Protective Ground Grid, Hubbell Power Systems, Inc., http://www.lubbellpowersystems.com/lineman/grounding/ground-grids/ground-grid.asp, 2 pp.

* cited by examiner

EQUIPOTENTIAL GROUNDING GRATE

CROSS REFERENCE TO RELATED APPLICATIONS

This application claims the benefit of U.S. Provisional Patent application Nos. 62/523,671 filed Jun. 22, 2017; 62/524,366 filed Jun. 23, 2017; and 62/566,972 filed Oct. 2, 2017; the disclosures of each are incorporated herein by reference.

BACKGROUND OF THE INVENTION

1. Field of Invention

This disclosure generally relates to equipotential grounding structures for bonded work zones, and, more particularly, to grates that are self-supporting and do not require an underlying solid mat for support.

2. Description of Related Art

Existing equipotential grounding mats include a wood mat—such as a timber access mat—combined with a removable conductive cover that is re-usable after the wood mat deteriorates. Another example uses a polymer mat below a metal cover. U.S. Pat. Nos. 9,458,578 and 9,368,918 disclose examples of these devices. These devices are used to create an equipotential ground and bonded work zone. The devices are positioned on the ground to create an equipotential zone for puller and tensioner sites. According to the Safety, Health and Environmental Program Manual, establishing an equipotential zone for puller and tensioner sites protect employees performing wire stringing operations at the puller or tensioner/reel stand location and the equipment should be positioned on an established equipotential work zone. During stringing wire, tensioning or removing de-energized conductors there is the possibility of the conductor accidentally contacting an energized circuit or receiving a dangerous induced voltage buildup. To further protect the employee from the hazards of the conductor, the conductor being installed or removed shall be grounded or provisions made to insulate or isolate the employee. Prior to stringing parallel to an existing energized transmission line, a competent designation shall be made to ascertain where dangerous induced voltage buildups could occur, particularly during switching and ground fault conditions. When there is a possibility that such dangerous induced voltage may exist, all provisions of equipotential grounding and bonding must be followed. All pulling and tensioning equipment shall be isolated, insulated, and effectively grounded.

A drawback with such devices is that the weight and bulk of the underlying timber or polymer mats must be delivered to the work site, handled during set-up, and transported upon completion in addition to the conductive metal covers.

SUMMARY OF THE DISCLOSURE

The disclosure provides self-supporting equipotential grounding grates that are used to create an equipotential zone for workers and equipment. The grates have supports that cooperate to position the upper surface of a conductive grid above the surface on which the grates are used. The grate supports workers and equipment. A plurality of the grates are electrically connected with cables to define a platform with the entire structure grounded with one or more grounding pins.

The disclosure provides self-supporting equipotential grounding grates that are used to create an equipotential zone for workers and equipment. The grates include a substantially closed floor and a conductive grid supported in a spaced configuration above the closed floor. The closed floor includes portions disposed at different heights to provide interruptions to the lower ground-engaging surface of the grates. This uneven floor increases traction between the grate and the ground. The closed floor also limits the amount the grate is pressed into the ground.

Some configurations of the grate include a conductive grid defined by spaced ribs connected by ties with the ties having heights less than the ribs. The grid is carried on a lower support structure defined by ribs connected by ties with the ties having heights less than the ribs. The ribs of the lower support structure are spaced apart farther than the ribs of the conductive grid. The ribs of the lower support structure are taller than the ribs of the conductive grid. Continuous channels are thus defined between the lower ribs that allow debris to be removed from the grate.

The disclosure provides self-supporting equipotential grounding grates that have continuous channels disposed under the conductive grid to allow the grates to be cleaned of debris that gathers in the grate from the elements and from vehicle tires and workers' boots that engage the conductive grid. The lower channels are wider than the openings in the conductive grid.

The preceding non-limiting aspects, as well as others, are more particularly described below. A more complete understanding of the processes and the structures of the grates can be obtained by reference to the accompanying drawings, which are not intended to indicate relative size and dimensions of the assemblies or components thereof. In those drawings and the description below, like numeric designations refer to components of like function. Specific terms used in that description are intended to refer only to the particular structure of the embodiments selected for illustration in the drawings, and are not intended to define or limit the scope of the disclosure.

DETAILED DESCRIPTION OF THE DISCLOSURE

Figure 1:
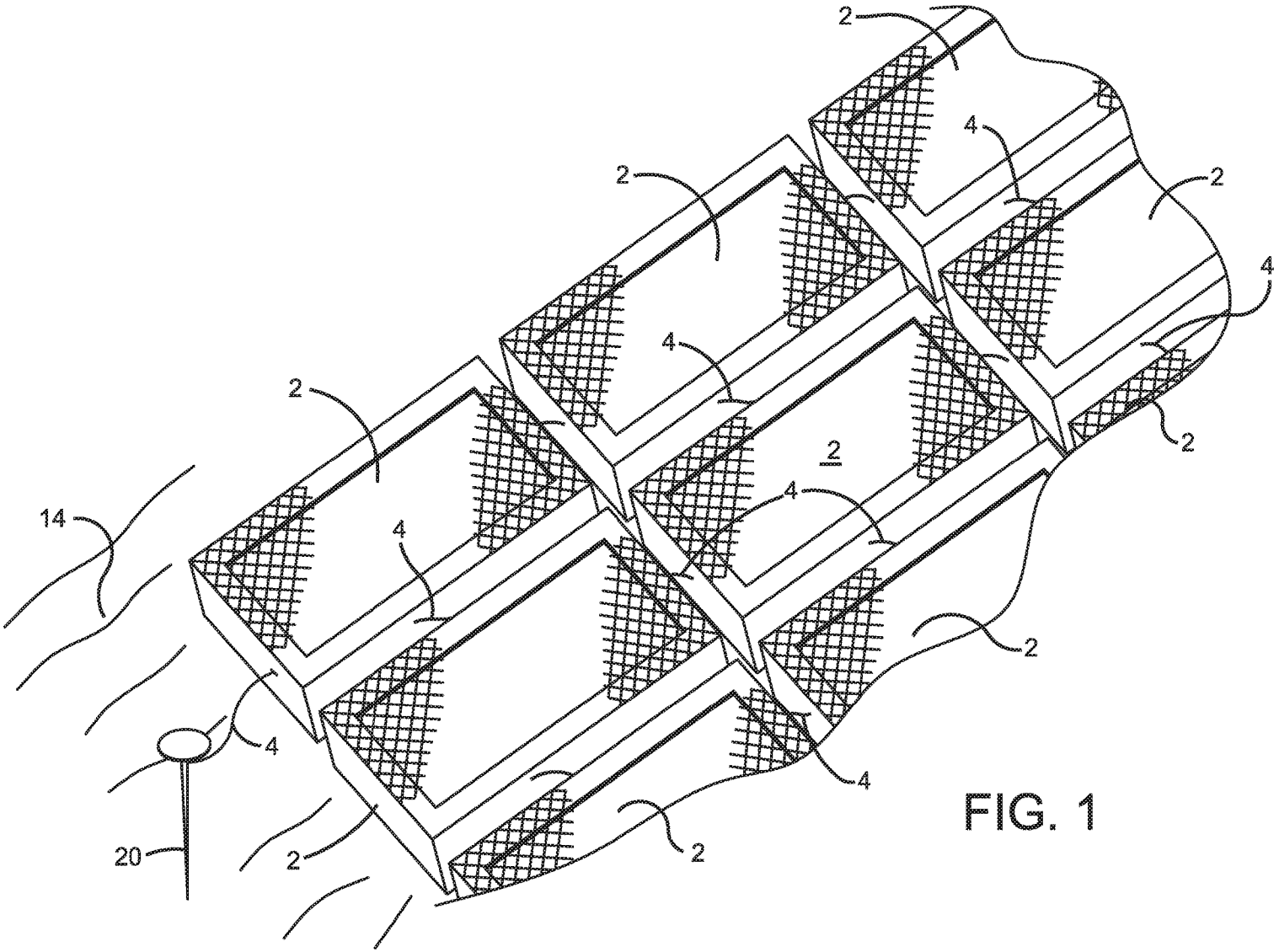
FIG. 1 is a perspective view of a plurality of electrically-connected grates forming an equipotential grounding zone.

The disclosure provides exemplary configurations of electrically groundable support grates for use on or near the surface of the earth for supporting workers and equipment. A plurality of exemplary support grates 2 are depicted in FIG. 1 forming an equipotential grounding platform capable of supporting workers and equipment such as trucks. Each grate 2 can be galvanized. Grates 2 are electrically connected with flexible cables 4 that allow grates 2 to be used on uneven ground. Each grate 2 is electrically conductive and the electric connections between grates 2 combined with a grounding pin 20 create an equipotential zone or EPZ work platform. Grates 2 are provided in sizes such as 4'×8', 4'×14', 8'×12', or 8'×14'. Other dimensions can be provided as desired for the different sizes of equipotential zones being created.

Figure 2:
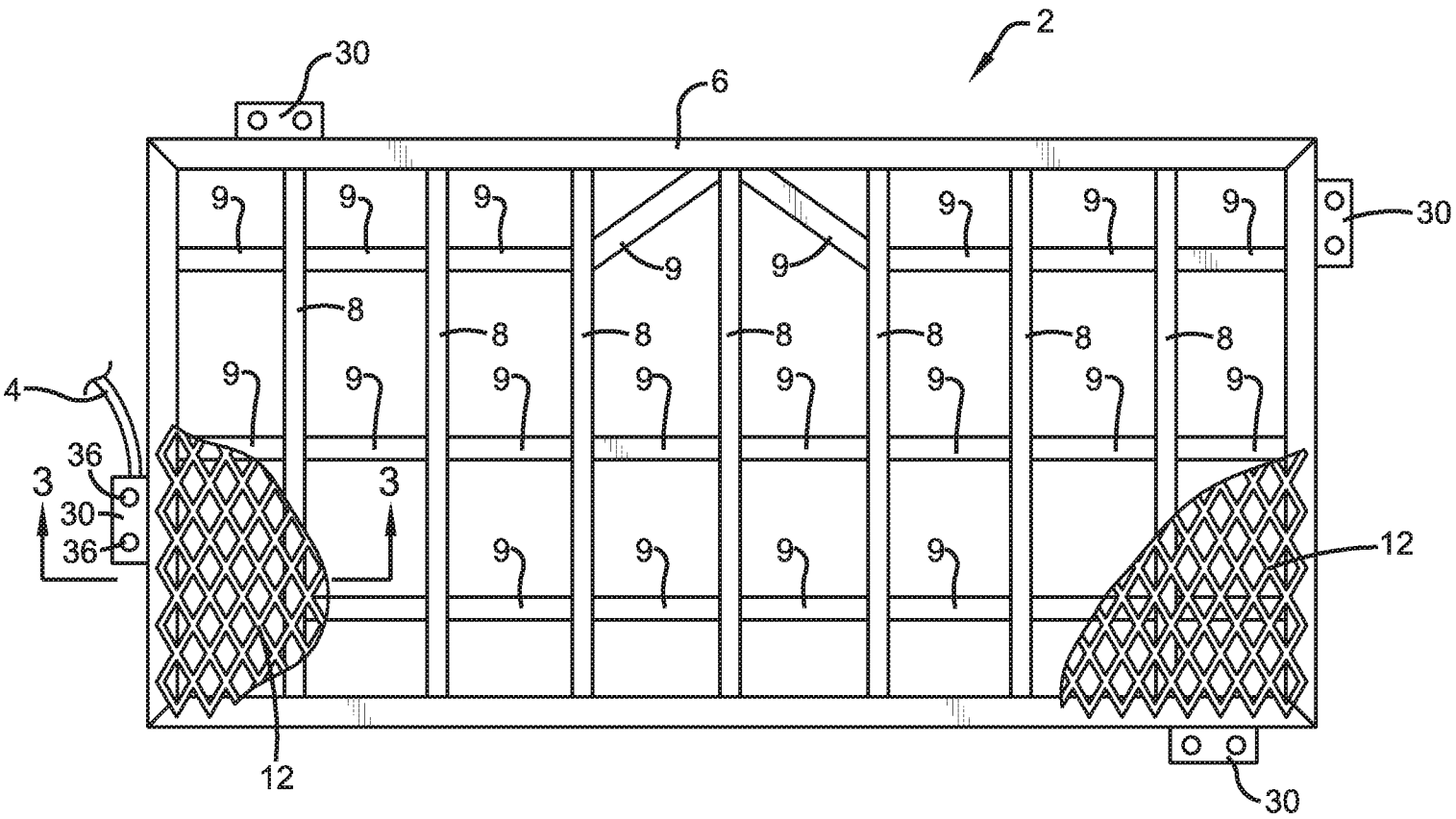
FIG. 2 is a top plan view of a single grate.
Figure 3:
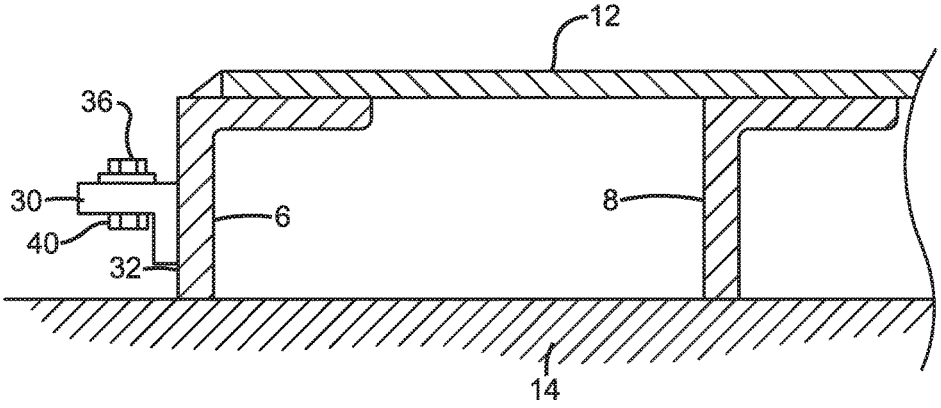
FIG. 3 is a section view taken along line 3-3 of FIG. 2.
Figure 4:
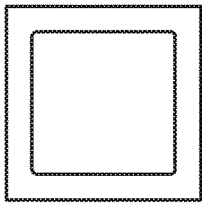
FIGS. 4-9 depict alternative frame and support member shapes.
Figure 5:
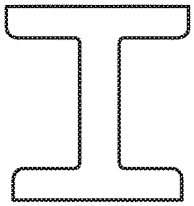
Figure 6:
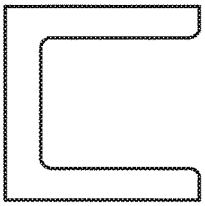
Figure 7:
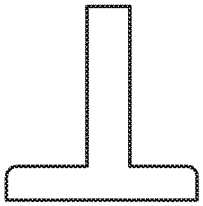
Figure 8:
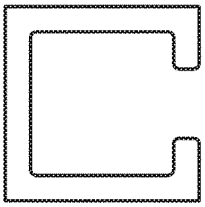
Figure 9:
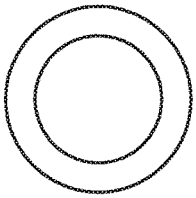

In the first exemplary configuration of FIGS. 2-9, each grate 2 includes a perimeter frame 6, a plurality of inner supports (which can be inner cross supports 8, inner longitudinal supports 9, or a combination of both) and a conductive grid 12. Frame 6, inner supports 8 and 9, and conductive grid 12 can be welded or bolted together to form an integral conductive grate 2. Frame 6 and inner supports 8 and 9 can be made from metal channels. These can be conductive and cooperate with conductive grid 12 to form conductive grounding paths. The channels can be two inch by two inch channels that support conductive grid 12 above the ground 14. Four inch to ten inch tall supports can be used to position the electrical connections and conductive grid 12 far enough above the ground to all grate 2 to function with softer ground in which the lower portions of grate 2 are depressed into the earth. 4×4 inch or 6×6 inch square tube are examples of frame and support members. Inner supports 8 and 9 can be positioned every one foot to three feet within frame 6. Inner longitudinal supports 9 can have the same size and cross section as inner cross supports 8 or can be different. For example, inner longitudinal supports 9 can be engaged with conductive grid 12 and have the same height as inner cross members 8 to help support grate 2 on firm ground. In another example, inner longitudinal supports 9 can be engaged with conductive grid 12 but have a height that is less than the height of inner cross supports 8 such that inner longitudinal supports 9 only engage the ground after inner cross supports 8 are pushed into soft ground. The height can be 60-90 percent less. In another embodiment, the heights of supports 8 and 9 can be reversed. Both types of inner supports prevent conductive grid 12 from being pressed into the ground. Supports 8 and 9 can be perpendicular as shown in FIG. 2 or they can be disposed at other angles (FIG. 2 depicts an example of two supports 9 disposed at non-perpendicular angles) to provide support to conductive grid 12. For both frame and supports 8 and 9, the cross sections with broad bases shown in FIGS. 4-9 are desirable for use with softer surfaces.

In some configurations, conductive grid 12 is in the form of a conductive mesh, conductive fencing, or conductive screen made of electrically conductive material such as steel or aluminum. Conductive grid 12 extends across the entire upper surface of grate 2 except the outermost edges. Another configuration uses a thin perforated metal foil as the conductive grid 12. One or a plurality of conductive grids 12 can be used. An advantage to using the mesh, screen, or expanded metal is that the size of the gaps between conductive elements is small and a person standing on grate 2 is guaranteed to be in contact with multiple locations of conductive grid 12. Each opening in grid 12 has a maximum opening dimension (width, length or diameter) which is smaller than the maximum opening dimension of the support structure disposed under grid 12. As such, any debris passing through grid 12 will also be able to pass through or be gathered by the openings defined by the lower support structure. Conductive grid 12 can be bolted or welded to frame 6.

Conductive grid 12 also can be wrapped around the sides of frame 6 and bolted to the sides or bottom of frame 6. Conductive grid 12 also can be welded or bolted to supports 8.

Flexible electrical cables 4 are connected to frame 6. Cables 4 can be located near the corners of frame 6. A single or a plurality of cables 4 can extend from each location. Cables 4 are used to connect grates 2 or connect grate 2 to a grounding pin 20 that is driven into the ground 14. Cables 4 can be bolted to frame 6 but also can be welded to frame 6. Each cable 4 can carry a bolt receiver at its loose end for receiving a bolt that is used to secure cable 4 to another grate 2 or to grounding pin 20. Cables 4 are 4/0 (four aught).

A plurality of connector tabs 30 extend from the vertical walls 32 of frame 6. Each connector tab 30 is positioned far enough below the upper surface of frame 6 to prevent any portion of the electrical connection from protruding above frame 6 or conductive grid 12. Each connector tab 30 is positioned at or above a distance that is half the height of frame 6 to reduce the chance that connector tab will be pressed into soft ground during use. For example, when frame 6 is made from six inch tubular stock, connector tab 30 can be positioned four to five inches from the bottom surface of frame 6. Connector tabs 30 extend generally horizontal from vertical walls 32. Connector tabs 30 can be formed by welding or securing with mechanical connectors L-shaped lengths of metal to the outer side surfaces of frame 6. Connector tabs 30 are arranged in complementary positions on opposite walls of frame 6 such that grates 2 can be arranged side-by-side without connector tabs 30 interfering with each other. Connector tabs 30 may directly abut the other frame 6.

In this configuration, each cable lead 10 is secured to connector tab 30 with a pair of bolts 36 that position the end of cable lead 10 parallel (and substantially horizontal) to the wall of frame 6 from which connector tab 30 extends. This keeps the ends of cable leads 10 out of the way when grates 2 are disposed edge-to-edge. Each connector tab can define space for multiple cable lead ends. Bolts 36 can be threaded into threaded openings or into threaded nuts 40 welded to the bottom of connector tab 30. This configuration allows bolts 36 to be secured from above when grates 2 are disposed edge-to-edge.

Figure 10:
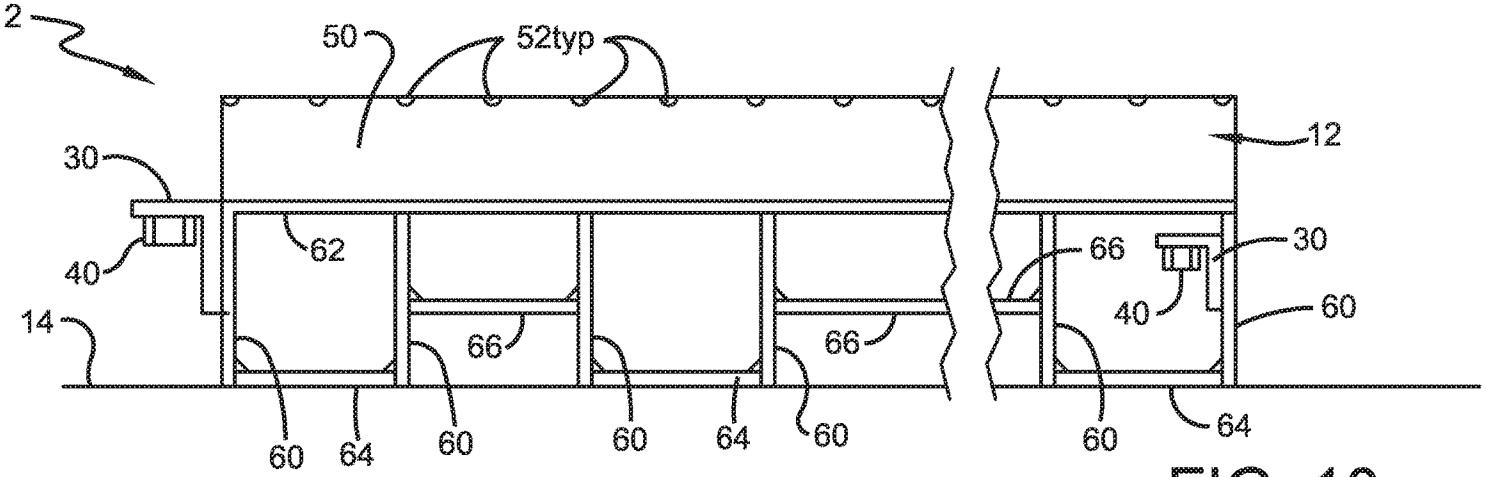
FIG. 10 is an end elevation view of another exemplary grate.
Figure 11:
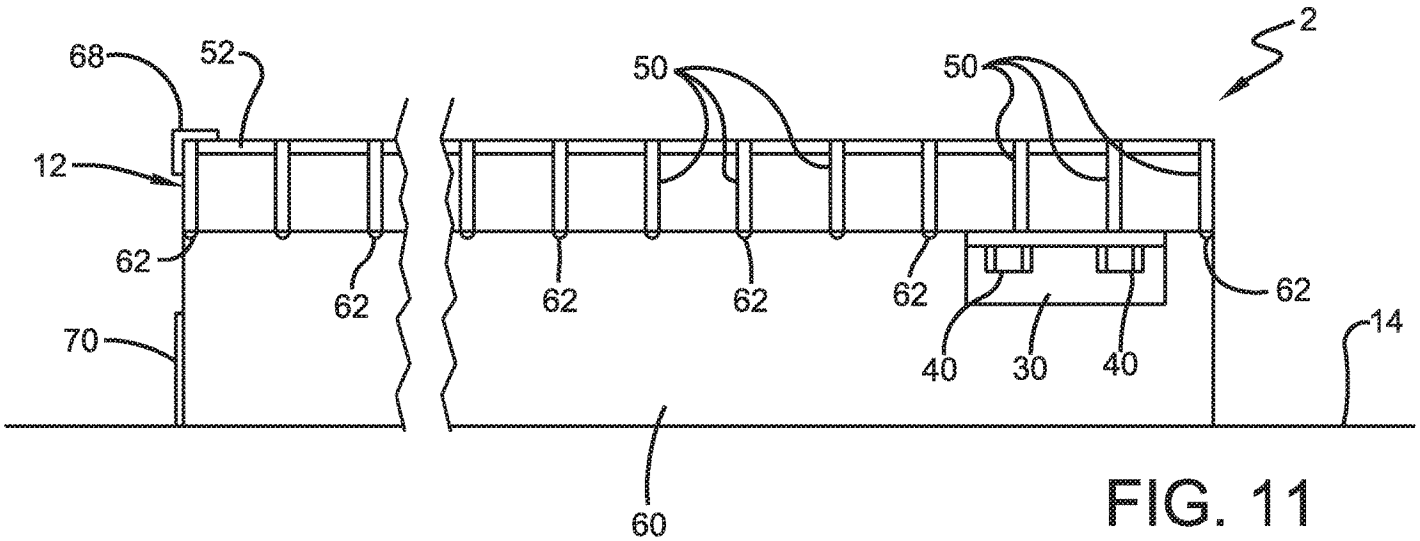
FIG. 11 is a side elevation view of the grate of FIG. 10.
Figure 12:
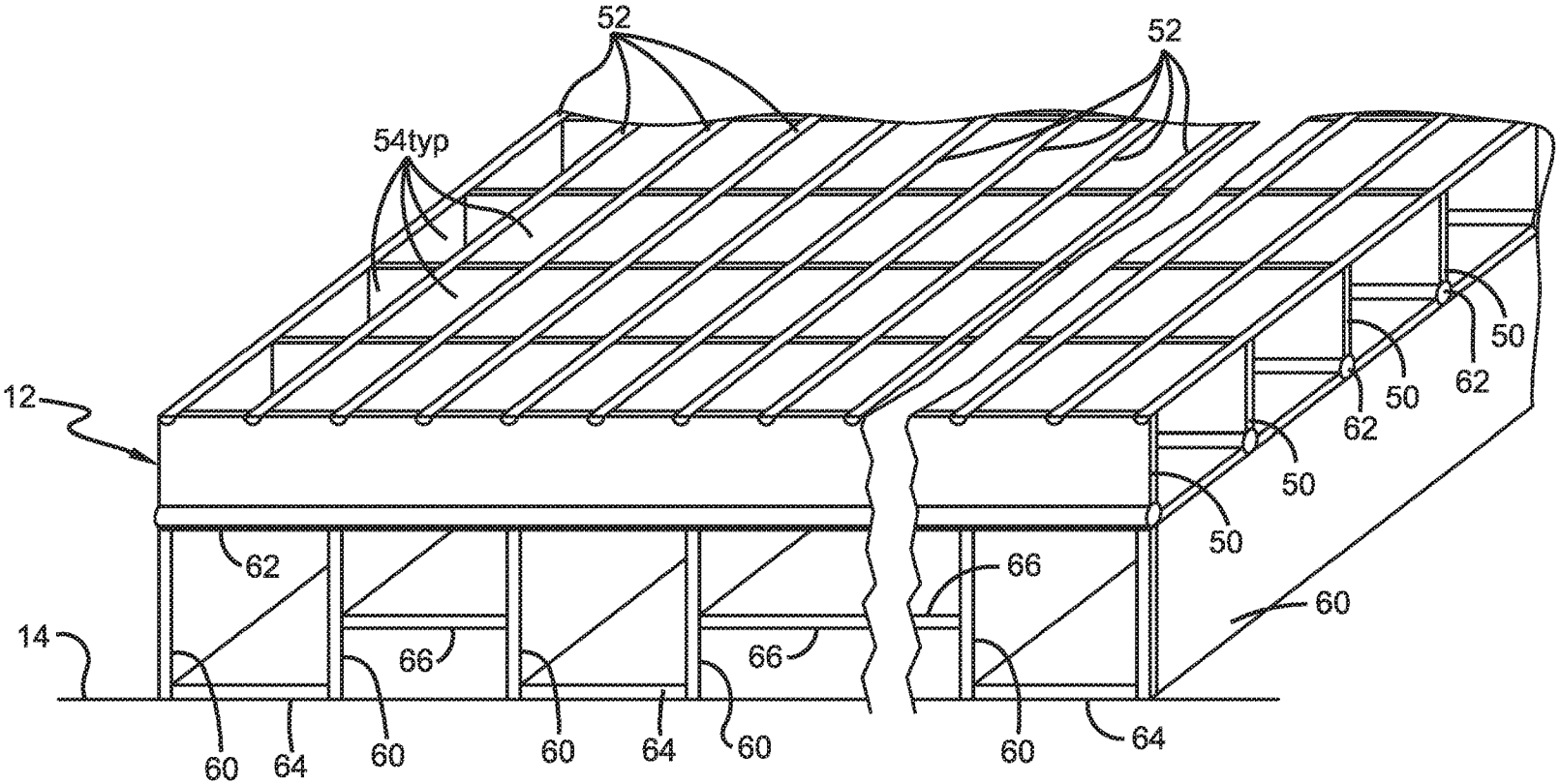
FIG. 12 is a perspective view of the grate of FIGS. 10-11.
Figure 15:
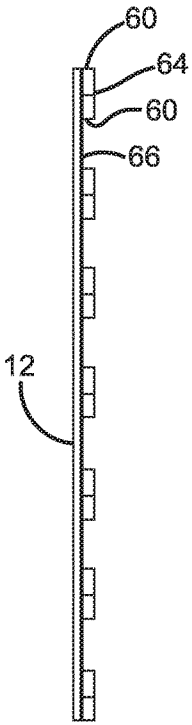
FIG. 15 is an end elevation view of the grate of FIG. 13.
Figure 13:
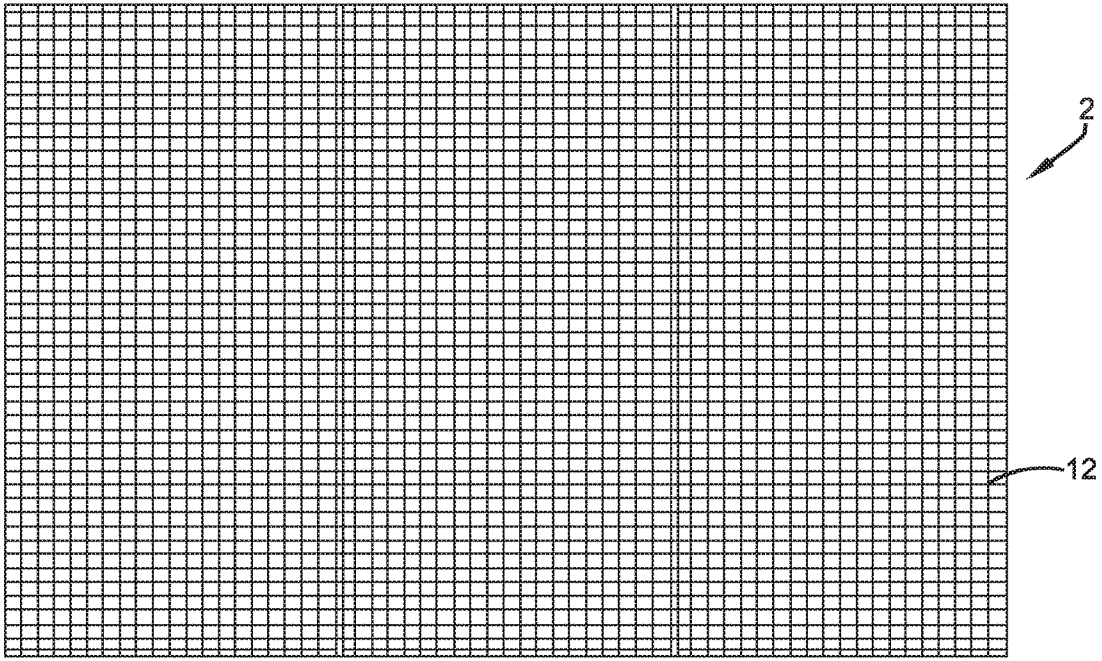
FIG. 13 is a top plan view of another exemplary grate.
Figure 14:
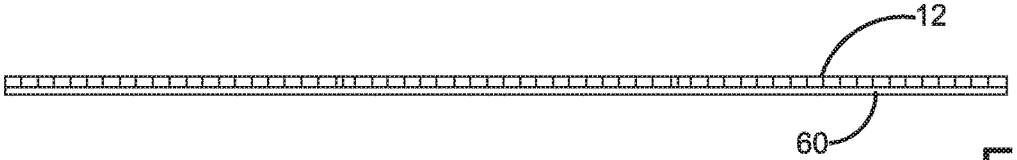
FIG. 14 is a side elevation view of the grate of FIG. 13.

FIGS. 10-12 depict another exemplary configuration of grate 2 that can be combined with a plurality of like grates 2 to form a platform that defines an equipotential grounding zone. Grate 2 is capable of supporting workers and equipment. In this configuration, conductive grid 12 is supported by a lower support structure having a plurality of supports with open ends to allow grate 2 to be cleaned out through two of its ends.

In the configuration of FIGS. 10-12, grid 12 is formed from a plurality of upper ribs 50 that are connected along their upper ends by a plurality of parallel upper ties 52. Ribs 50 and ties 52 are steel and are welded together. Ribs 50 can be one to three inches tall. In one configuration, ribs 50 and ties 52 are evenly spaced define a grid of roughly two inch square openings 54. Ties 52 have a height that is less than the height of ribs 50 such that open channels between ribs are defined through grid 12. Each tie 52 has a height that is less than fifty percent of the height of rib 50. In the exemplary configuration, the height of each tie 52 is less than twenty percent the height of rib 50. The open channels between ribs 50 beneath ties 52 allow debris that falls into or is pressed into grid 12 to break up and move to a location where it can fall down into the lower support structure.

Grid 12 is disposed on top of a lower support structure that is constructed from a plurality of parallel lower ribs 60 that are connected along their upper ends by a plurality of parallel lower ties 62. Ribs 60 are taller than ribs 50 in the exemplary configurations and can be three to five inches tall and spaced apart three to five inches. In general, grate 2 has the lower support structure with taller ribs 60 that are spaced farther apart than upper ribs 50. In other configurations, different spacing and height configurations are used. Each tie 56 has a height that is less than fifty percent of the height of rib 60. In the exemplary configuration, the height of each tie 62 is less than twenty percent the height of rib 60. In the exemplary configuration, lower ties 62 are spaced to provide openings larger than openings 54. The openings defined by lower ribs 60 and lower ties 62 can be rectangular or square. These larger openings allow debris that enters grid 12 to move down into the lower support structure where it does not interfere with the upper surface of grid 12 and where it can be removed from grate 2 when grate 2 picked up and moved. Lower ribs 60 and lower ties 62 are made from steel and are welded together.

In some configurations, ties 52 and 62 are inset into notches defined by the upper ends of ribs 50 and 60 to allow the support structures to be connected together and to provide a flat upper surface to grate 2. FIG. 10 depicts the upper surfaces of ribs 50 and ties 52 being coplanar.

Floor plates 64 are disposed between some pairs of lower ribs 60 to provide flat support surfaces that limit the extent that grate 2 can be pressed into ground 14. Floor plates 64 can be connected at the lower ends of ribs 60. Plates 64 can be disposed at different heights with respect to ribs 60 to define an uneven floor. In the exemplary configuration of FIGS. 10-12, floor plates 64 alternate with raised floor plates 66 to define an uneven floor having a corrugated or crenulated lower surface. This floor configuration provides grip between grate 2 and ground 14. Plates 64 and 66 are continuous and welded to ribs 60 to create a floor for grate 2. Raised floor plates 66 can defined channels between ribs 60 that have heights the same as or less than the channel heights of conductive grid 12. This floor limits the amount that grate 2 can be pressed into ground 14.

The floor will gather debris dropped into grate 2 from above. The configuration of ribs 60 spaced farther apart than the size of openings 54 allows this debris to be removed from grate 2 when it is lifted up on end or sprayed with water. The larger spacing and height of ribs 60 in the lower support allows compacted debris (dried mud combined with aggregate) to be broken up when grate 2 is lifted because grate 2 is flexible enough to bow to break up the dried mud to a degree where it falls out of the long channels defined by ribs 60 and floor plates 64 and 66.

Figure 16:
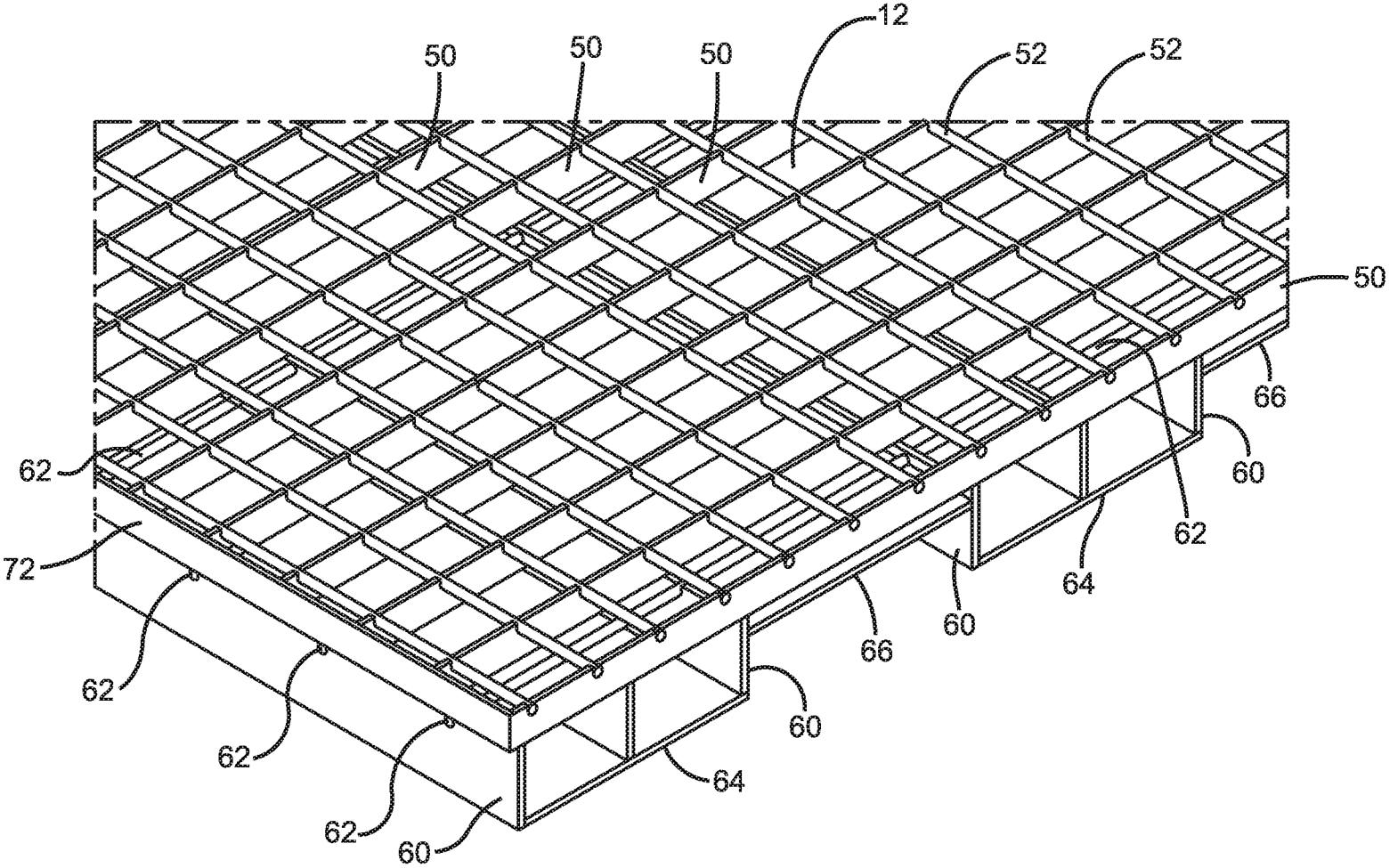
FIG. 16 is a perspective view of a corner of grate of FIGS. 13-15.
Figure 17:
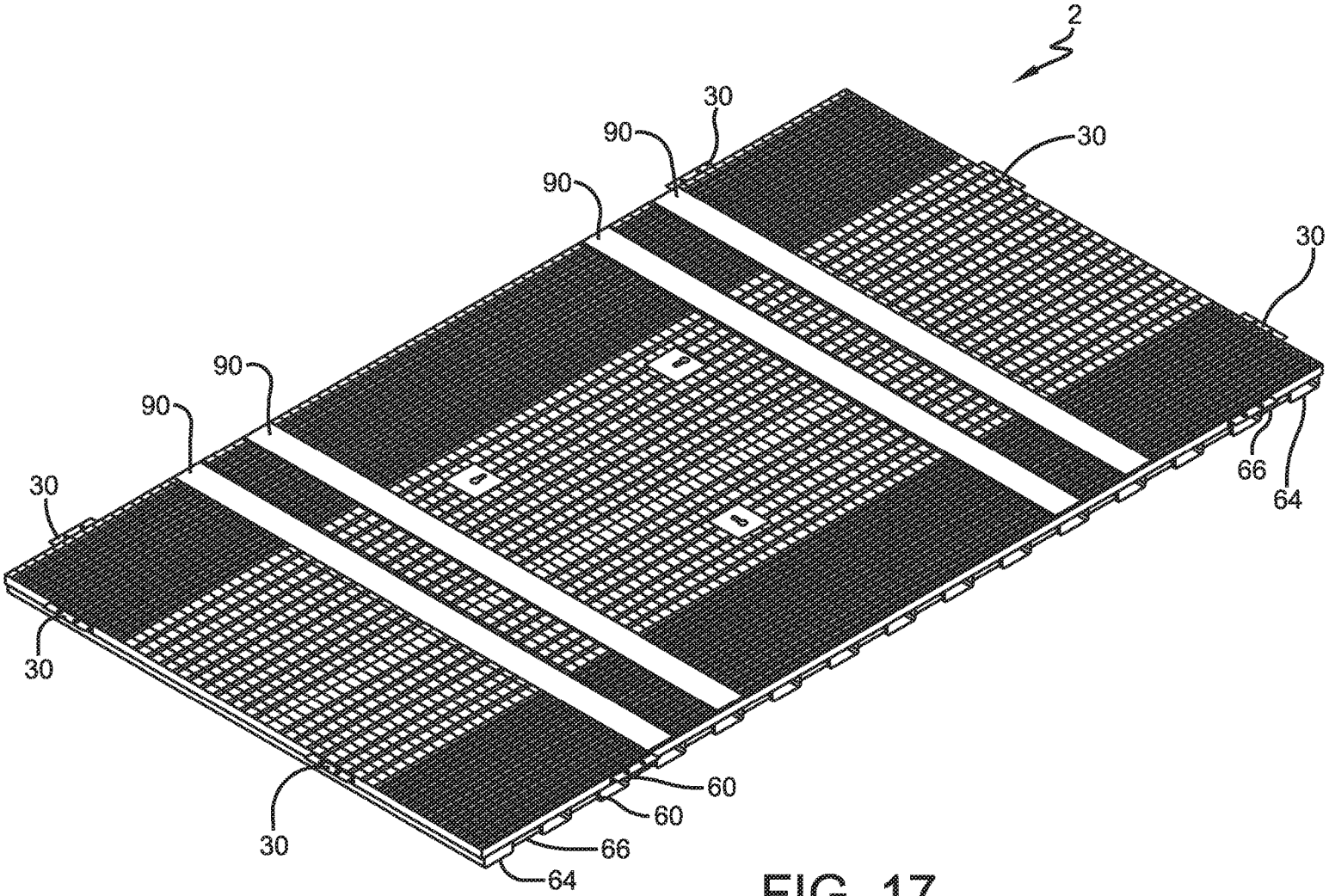
FIG. 17 is a perspective view of another exemplary grate.
Figure 18:
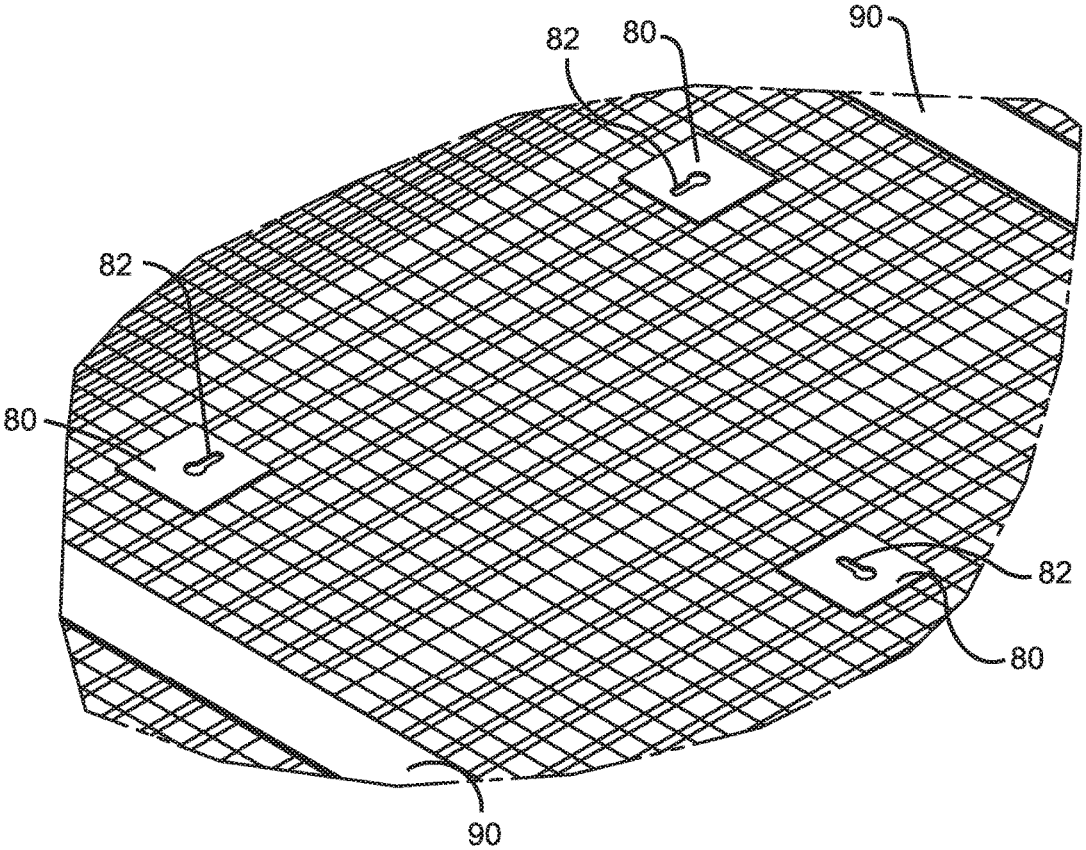
FIG. 18 is an enlarged view of the lifting plates.
Figure 19:
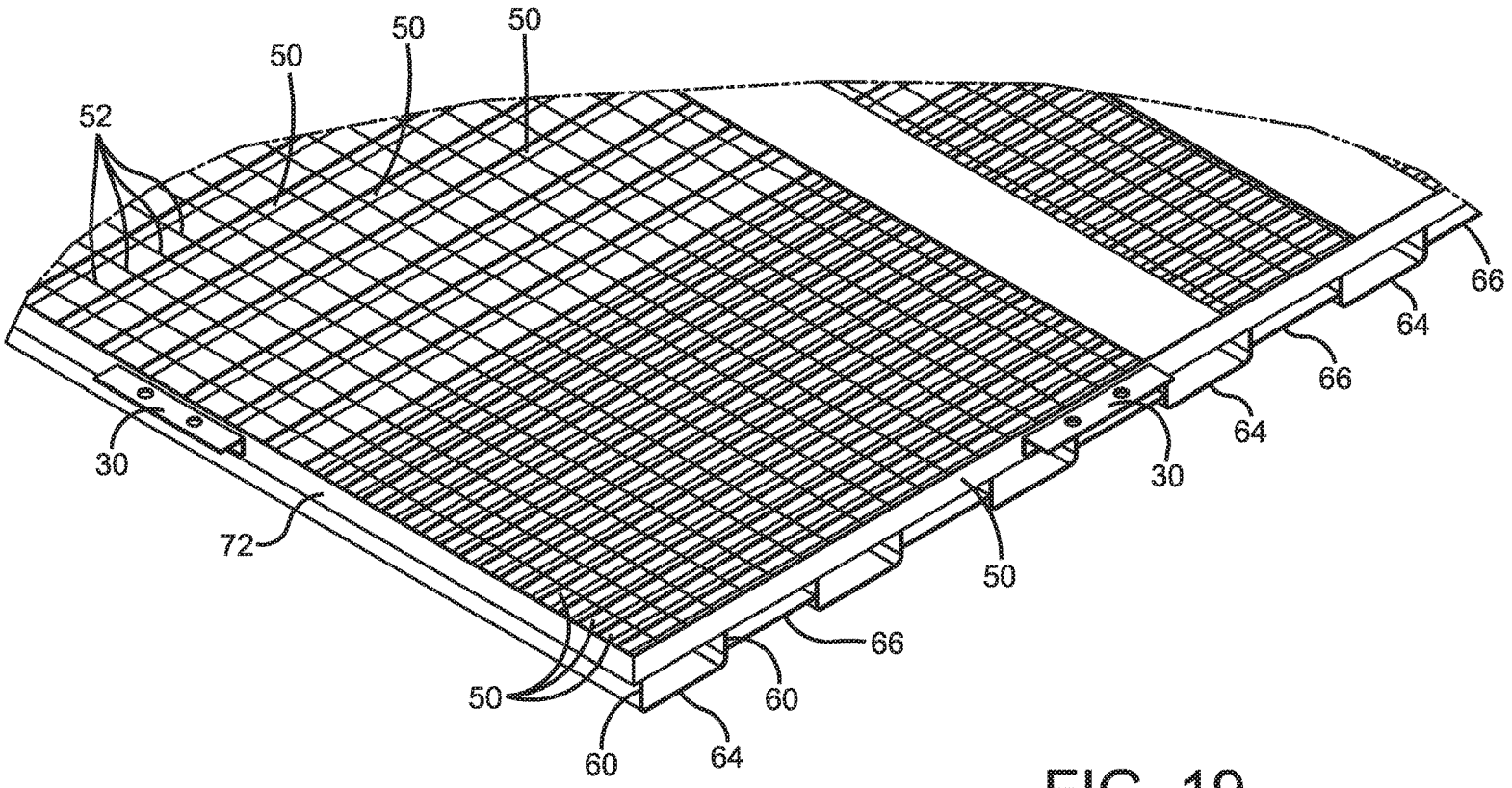
FIG. 19 is an enlarged view of a corner of the grate of FIG. 17 showing the doubling of the upper ribs along the edge of the grid.
Figure 20:
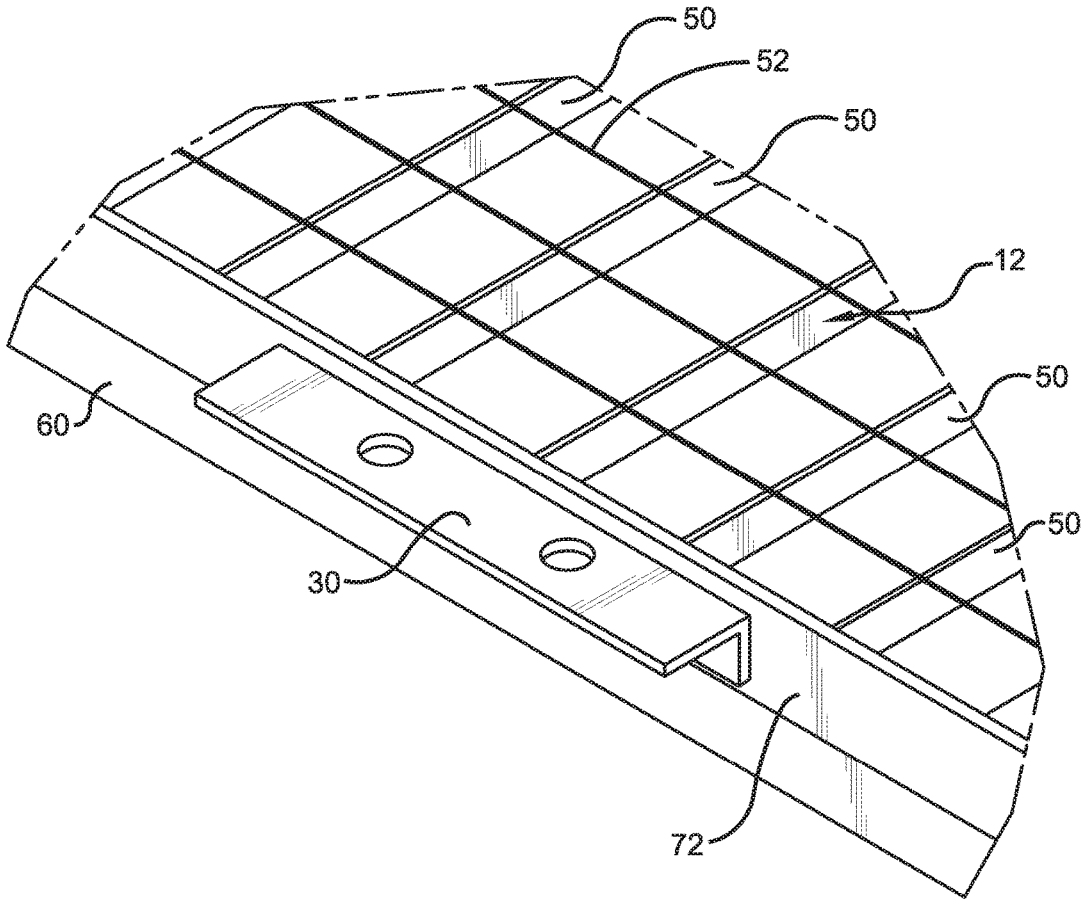
FIG. 20 is an enlarged view of a connector tab secured to an end plate.

Optional edge caps 68 can be provided to cover the ends of ties 52 as shown in FIG. 11. Optional full-height or partial height end plates 70 can be added over the exposed ends of ribs 60 to limit the ability of material to enter grate 2 through the ends of the channels defined between ribs 60. When the ends of these channels are capped with end plates 70, debris can be removed by flipping grate 2 over to allow debris to fall through ribs 50 and ties 52. Closing the ends of ribs 60 limits the amount of water that will flow into grate 2 from the ends. FIGS. 16, 17, and 19 depict an optional end plate 72 that caps the ends of upper ribs 50 and provides a structure to support connector tabs 30.

Two pairs of connector tabs 30 can be disposed on each side of grate 2. Tabs 30 can be welded to the outside side surface of ribs 60 as shown in FIGS. 10-11, to the ends of multiple ribs 60, or tabs 30 can be disposed inside the outer perimeter of grate 2 by locating tabs 30 near the corners of grate 2 and connecting them to the inner side surfaces of ribs 60 (see right side of FIG. 10). These can be accessed from above through openings 54.

The lower support structure can be made in three sections of about 4'×8' which are disposed next to each other to define a 12'×8' lower support section. Conductive grid 12 can be made from a pair of about 4'×12' support structures which are disposed side-by-side on top of the 12'×8' lower support structure and all are welded together. Other combinations can be used to define grates 2 of other sizes.

FIGS. 13-16 depicted another configuration of grate 2 that is made from upper and lower support structures that are welded together. In this configuration, some ribs 60 are removed to provide larger areas for raised floor plates 66. These can be sized and configured to receive the forks of forklifts.

In the configurations of FIGS. 10-16, the entire body of grate 2 is conductive and welded together. After assembly and welding, each grate 2 can be galzanized. Flexible electrical cables 4 are connected to grates 2. Cables 4 can be located near the corners of grates 2. A single or a plurality of cables 4 can extend from each location. Cables 4 are used to connect grates 2 or connect grate 2 to a grounding pin 20 that is driven into the ground. Cables 4 can be bolted to grates 2 but also can be welded to grate 2. Each cable 4 can carry a bolt receiver at its loose end for receiving a bolt that is used to secure cable 4 to another grate 2 or to grounding pin 20. Cables 4 are 4/0 (four aught).

In the configuration of FIGS. 17-20, each grate 2 includes a plurality of lifting plates 80 that are used to lift grate 2 with chain. Each lifting plate 80 defines a key hole 82 that allows the links of a chain to be inserted through plate 80 through the enlarged end of key hole 82. A link of the chain is then slid into the thin portion of key hole 82. When the chain is pulled up away from plate 80, the chain link below plate 80 locks the chain to plate 80 and allows grate 2 to be lifted. Plates 80 are welded to grid 12. Each plate 80 can include supports that connect plate 80 to lower ribs 60.

The configuration of FIGS. 17-20 also includes steel plate runners 90 disposed on top of grid 12 along the high traffic areas. These increase the durability of grate 2. Also as shown in FIGS. 17 and 19, the durability of grate 2 is increased by doubling upper ribs 50 along the edges of grate 2. Doubling the number of upper ribs 50 along the leading and trailing edges of grate 2 provides added strength against torsional forces created when heavy truck tires roll onto and off of the edge of grate 2. In the exemplary configuration, the number of upper ribs 50 is doubled along each edge at a width of five to thirty-three percent of the width of grate 2.

Figure 21:
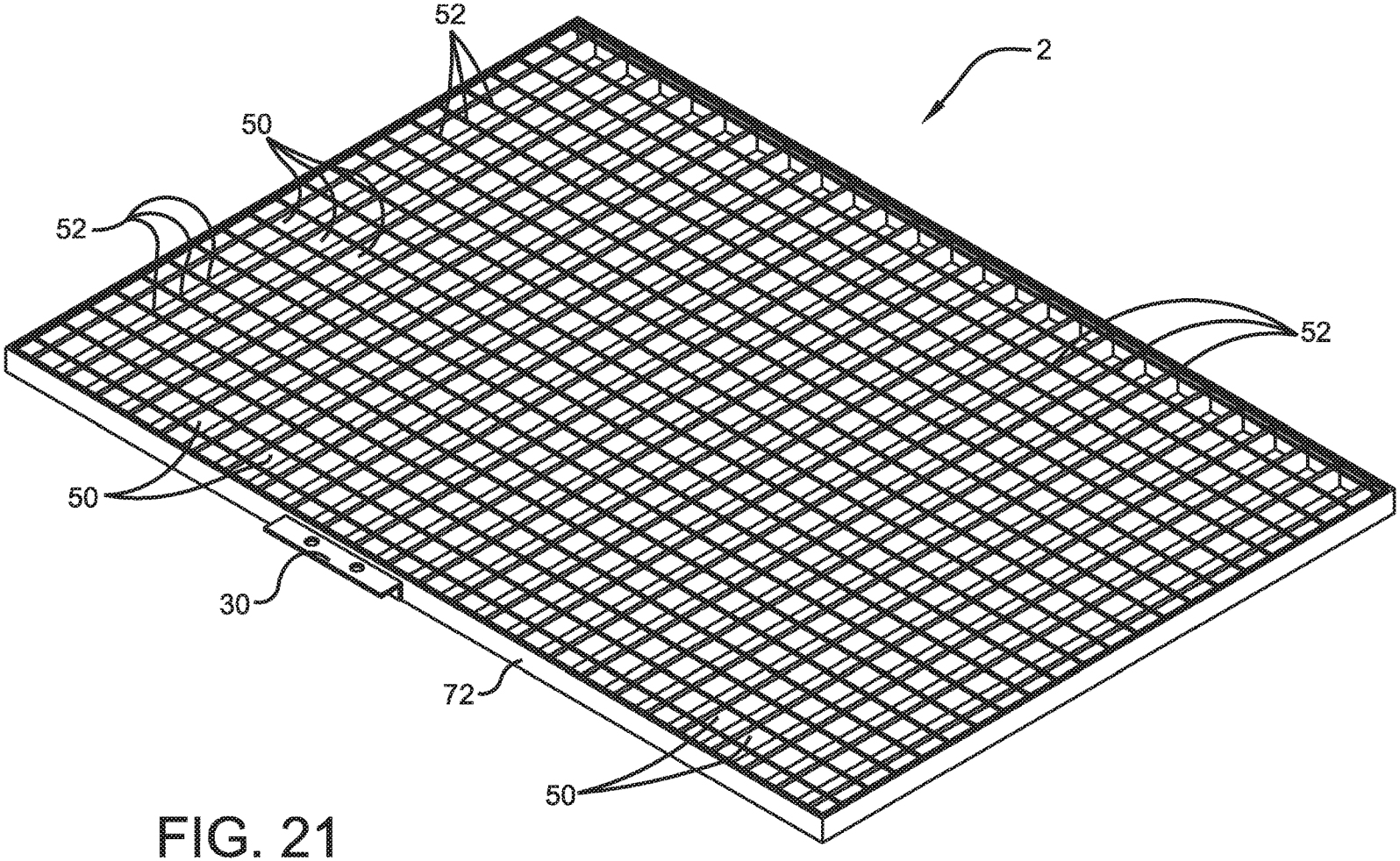
FIG. 21 is a view of a single layer conductive grate for use by a worker to create a person equipotential zone.

FIG. 21 depicts a conductive grid 12 defined by ribs 50 and ties 52 used as a stand-alone personal grounding grate 2. This grate can be 2×3 foot or 3×4 foot and is light enough to be picked up and carried by an individual worker. This grate can be bonded to the equipment on which the person is working and the grate can be grounded.

These configurations are self-supported and are used without the need to timber or polymer mats. Each grate 2 is capable of supporting line pulling and tensioning equipment and trucks.

Fences can be created about the outer perimeter of a equipotential zone by clipping traffic cones to grates 2 with vertical members extending up from the cones. Caution tape is connected to the vertical members to define the fence. In other configuration, the vertical members can be fit into the openings of grate 2. This can be frictional or sockets can be connected to grate 2 to receive the vertical fence members.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the descriptions and illustrations of the exemplary configurations are examples and the claimed invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. An electrically groundable support grate comprising:

an electrically conductive grid carried by a lower support structure; the lower support structure adapted to position the conductive grid above a surface on which the grate is positioned;

the conductive grid including a plurality of upper ribs connected by a plurality of upper ties; the plurality of upper ties connected to upper ends of the upper ribs;

the upper ribs and upper ties being a conductive metal;

each of the upper ribs having a height;

each upper tie having a height that is less than the height of the upper ribs;

the lower support structure including a plurality of lower ribs connected by a plurality of lower ties; the plurality of lower ties connected to upper ends of the lower ribs;

each of the lower ribs having a height; and the upper ribs being disposed substantially perpendicular to the lower ribs.

2. The grate of claim 1, wherein each of the lower ribs has the same height; each of the upper ribs having the same height; the height of the lower ribs being larger than the height of the upper ribs.

3. The grate of claim 1, wherein the upper ties are disposed in notches defined by the upper ribs to define a flat upper surface for the conductive grid with upper surfaces of the upper ties being disposed coplanar with upper surfaces of upper ribs.

4. The grate of claim 1, wherein the upper ribs are parallel to each other and spaced apart by a first rib distance; the lower ribs being parallel to each other and spaced apart by a second rib distance; the second rib distance between the lower ribs being larger than the first rib distance between the upper ribs.

5. The grate of claim 4, wherein the upper ties are parallel to each other and spaced apart by a first tie distance; the lower ties being parallel to each other and spaced apart by a second tie distance; the second tie distance between the lower ties being larger than the first tie distance between the upper ties.

6. The grate of claim 1, wherein the lower ribs and lower ties are an electrically conductive metal and further comprising a grounding pin connected to the grate with a flexible electrical connector.

7. The grate of claim 6, wherein the electrically conductive grid is welded to the lower support structure.

8. The grate of claim 1, further comprising an electrical connector tab disposed below an upper surface of the electrically conductive grid.

9. The grate of claim 8, further comprising a flexible electrical connector connected to the electrical connector tab.

10. The grate of claim 1, further comprising floor plates disposed between lower ribs.

11. The grate of claim 10, wherein the floor plates are positioned at different heights with respect to the lower ribs to define an uneven floor.

12. The grate of claim 11, wherein a plurality of the floor plates are connected to lower end of the lower ribs.

13. An electrically groundable support grate comprising:

an electrically conductive grid carried by an electrically conductive lower support structure; the conductive lower support structure adapted to position the conductive grid above a surface on which the grate is positioned;

the conductive grid being a conductive metal defining a plurality of openings; each of the openings in the conductive grid having a maximum opening dimension;

the conductive lower support structure including a plurality of lower support members defining plurality of lower openings; each of the lower openings having a maximum opening dimension; and a majority of the lower openings having a maximum opening dimension greater than the maximum opening dimension of a majority of the plurality of openings defined by the conductive grid.

14. The grate of claim 13, wherein the lower support structure includes an electrically conductive frame and a plurality of electrically conductive inner supports.

15. The grate of claim 14, wherein the electrically conductive grid is welded to the electrically conductive lower support structure.

16. An electrically groundable support grate comprising:

an electrically conductive upper structure carried by a lower support structure; the lower support structure adapted to position the conductive upper structure above a surface on which the grate is positioned;

the lower support structure including a plurality of parallel lower ribs having upper ends and lower ends; a lower rib height being defined between the lower end and the upper end of each lower rib;

a plurality of floor plates connected to the lower ribs; and wherein the floor plates are positioned at different heights with respect to the lower ribs to define an uneven floor.

17. The grate of claim 16, wherein a plurality of the floor plates are connected to lower end of the lower ribs.

18. The grate of claim 16, wherein the electrically conductive upper structure is a conductive metal defining a plurality of openings.

19. The grate of claim 18, wherein the electrically conductive upper structure includes a plurality of upper ribs connected by a plurality of upper ties; the upper ribs being parallel to each other and spaced apart by a first rib distance; the lower ribs being spaced apart by a second rib distance; the second rib distance between the lower ribs being larger than the first rib distance between the upper ribs.

20. The grate of claim 19, wherein the height of the lower ribs is larger than the height of the upper ribs.

* * * * *